United States Patent [19]

Minnis et al.

[11] 4,251,193

[45] Feb. 17, 1981

[54] FLOW CONTROL VALVE

[75] Inventors: Gary R. Minnis, Saginaw, Mich.; John L. Stiles, St. Albans, England

[73] Assignee: General Motors Corporation, Detroit, Mich.

[21] Appl. No.: 79,970

[22] Filed: Sep. 27, 1979

[51] Int. Cl.[3] ..... F04B 49/00

[52] U.S. Cl. ..... 417/300; 137/117; 417/307

[58] Field of Search ..... 417/300, 307, 308, 310; 137/101, 115, 117

[56] References Cited

U.S. PATENT DOCUMENTS

| | | | |
|---|---|---|---|
| 2,018,119 | 10/1935 | Brouse | 417/300 X |
| 3,349,714 | 10/1967 | Grenier | 417/300 |
| 3,508,575 | 4/1970 | Robinson | 417/310 X |

*Primary Examiner*—Carlton R. Croyle

*Assistant Examiner*—Edward Look

*Attorney, Agent, or Firm*—Donald F. Scherer

[57] ABSTRACT

A flow control valve has a slidable valve member and a variable orifice structure. The valve member slides in response to a pressure differential, created by fluid flow through the variable orifice, to bypass fluid in a positive displacement pump. The variable orifice is a self-contained unit including a longitudinally movable pin having a variable cross section disposed in an aperture. The pin position in the aperture controls the size of the orifice and thereore imposes a flow restriction which creates the pressure differential. The flow control valve is useful with power steering hydraulic pumps and systems where it is desirable to reduce the amount of hydraulic fluid which is delivered to the steering mechanism when the pump input speed exceeds a predetermined value.

3 Claims, 3 Drawing Figures

FLOW CONTROL VALVE

This invention relates to flow control valves and more particularly to such valves wherein a variable output flow is provided.

It is an object of this invention to provide an improved flow control valve structure in which a variable cross-sectional flow restriction is provided.

It is another object of this invention to provide an improved flow control structure wherein a longitudinally movable member having a variable cross-sectional area is disposed within an orifice to provide a changing flow control area and wherein the longitudinally movable member abuts a fixed surface to maintain a constant flow area after a predetermined amount of longitudinal movement.

These and other objects and advantages of the present invention will be more apparent from the following description and drawings in which.

Figure 1:
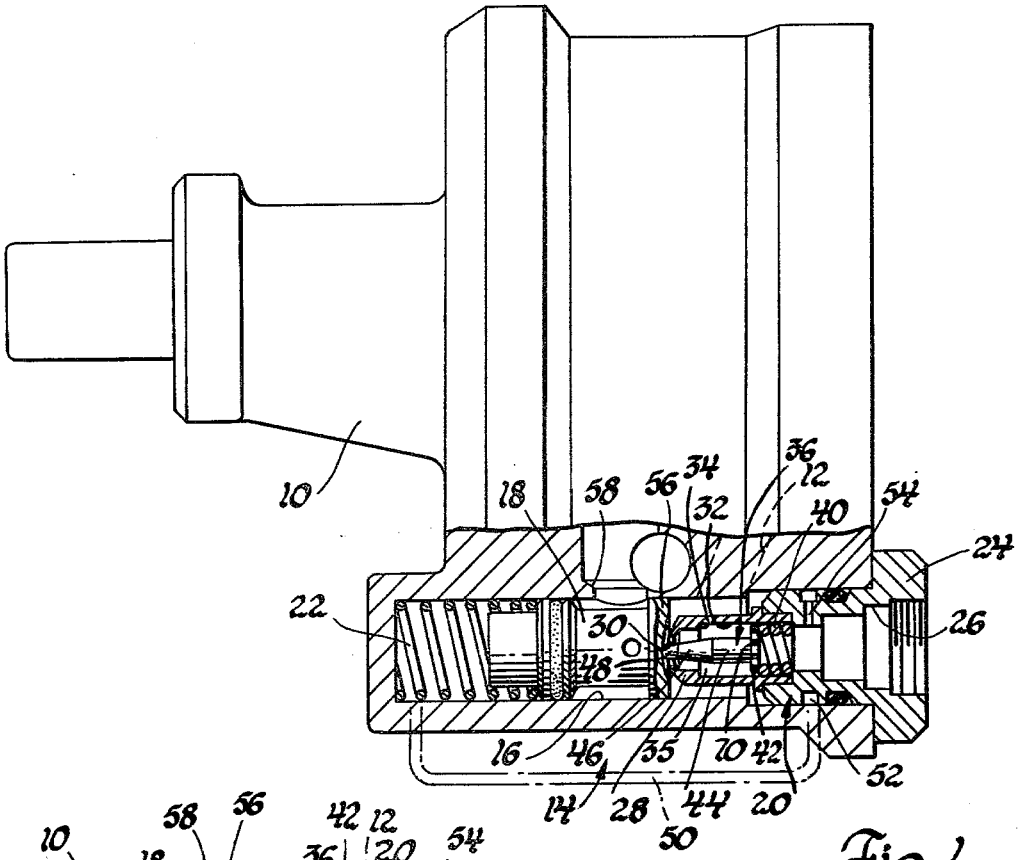
FIG. 1 is a partial cross-sectional view showing a flow control valve.

Referring to the drawings, wherein like characters represent the same or corresponding parts, there is seen a pump housing 10 which encloses a positive displacement vane type pump, not shown. The pump, with the exception of the flow control valve, can be constructed in accordance with the pump shown in Zeigler et al. U.S. Pat. Nos. 3,207,077 issued Sept. 21, 1965, and Zeigler et al. 3,253,548 issued May 31, 1966.

The output flow from the pump within housing 10 is directed through a passage 12 to a flow control valve, generally designated 14. The flow control valve 14 includes a valve bore 16 formed in the housing 10, a valve spool 18 slidably disposed in the bore 16, and an encapsulated variable flow restriction 20 which is secured in one end of the bore 16. The valve spool 18 is urged toward flow restriction 20 by a coil spring 22.

The variable restriction 20 includes a plug 24, secured in the bore 16, having a central fluid passage 26 adapted to permit hydraulic fluid from the pump to be delivered to a hydraulic system. Secured to the plug 24 is an orifice housing 28 which has an orifice or aperture 30 formed in one end thereof which is longitudinally aligned with the passage 26. The orifice housing 28 has a stepped internal diameter 32 which forms a shoulder 34 and also provides an enlarged fluid passage 35 which is longitudinally aligned to communicate fluid from aperture 30 to passage 26. Disposed within the stepped diameter 32 is a pin member 36 which is urged in the longitudinal direction toward the left or valve spool 18, by a compressure spring 40. The compression spring 40 has lesser force storage capacity than the spring 22 such that in the "at rest" or very low flow condition, the valve spool 18 and pin 36 will be maintained in the position shown in FIG. 1.

The pin 36 has an enlarged shoulder or head end 42 which is abutted by the spring 40, a cylindrical section 44, a tapering section 46 and an end cylindrical section 48. The end of cylindrical section 48 abuts the valve spool 18 in the position shown in FIG. 1, and maintains the aperture 30 open so that fluid flowing through passage 12 can be directed outwardly from the pump through passage 26.

The end of valve spool 18 adjacent spring 22 is connected by a fluid passage 50, shown in phantom lines, to a groove 52 formed in plug 24 and connected by a radial passage 54 to passage 26. Thus, the end of valve spool 18 adjacent spring 22 is in fluid communication with the fluid pressure which exists downstream of aperture 30 while the other end of valve spool 18 is in fluid communication with the fluid pressure upstream of aperture 30. Therefore, it will be appreciated that a pressure differential, caused by fluid flow through aperture 30, will operate on the valve spool 18 and have a resulting force on the valve spool 18 which urges the valve spool 18 to the left against spring 22.

Figure 3:
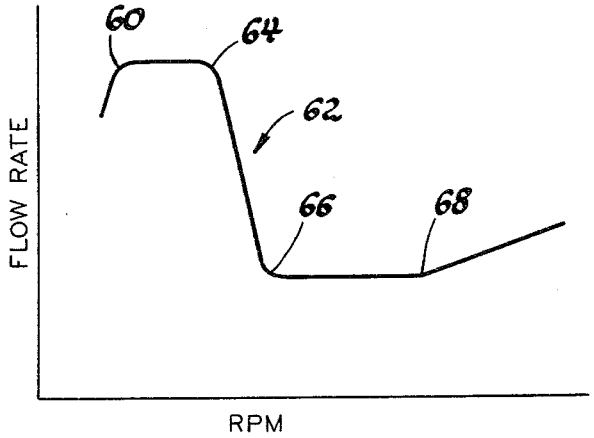
FIG. 3 is a chart depicting output flow rate versus pump input speed.

When the pressure differential across aperture 30 is sufficient, the valve spool 18 will move to the left an amount which is sufficient to permit the edge 56 of valve spool 18 to open a passage 58. The passage 58 is in fluid communication with the inlet of the pump in a well-known manner. Thus, at a predetermined pressure differential the valve spool 18 begins to recreate the output flow of the pump. This flow rate is shown as point 60 on the low curve designated 62 and shown in FIG. 3.

The spring 40 maintains the pin 36 in abutment with the valve spool 18 such that the effective cross-sectional area of aperture 30 is determined by the difference between the area of aperture 30 and the cross-sectional area of pin 36. During the initial movement of valve spool 18, the effective cross-sectional area remains constant since the cross section of area 36 is constant as the cylindrical section 48 passes through the aperture 30. This is represented by the flow rate between points 60 and 64 on curve 62.

Continued movement of valve spool 18 to the left, assuming valve input speed continues to increase, results in the tapered portion 46 entering the aperture 30 creating lesser effective cross-sectional area, and therefore increased pressure differential for a give flow rate as the tapered portion 46 passes through the aperture 30. The pump output flow rate decreases from point 60 to point 66 as seen on curve 62 due to the rapidly increasing pressure differential and the relatively constant rate of spring 22. The effective cross-sectional are is then maintained constant as the cylindrical portion 44 enters aperture 30. This represents a substantially constant output flow as shown between point 66 and point 68 on curve 62.

Figure 2:
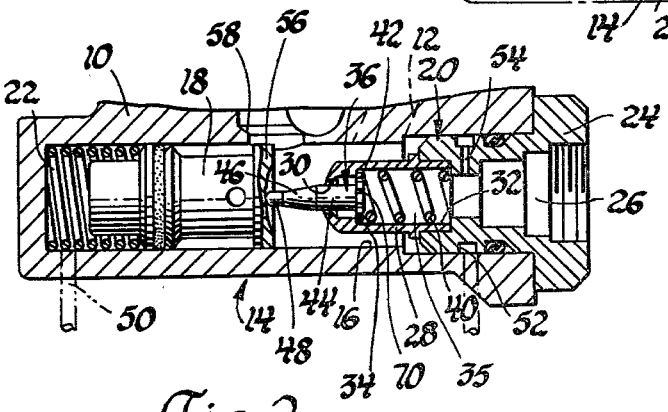
FIG. 2 is a partial cross-sectional view showing the flow control valve in another operating mode.

After a predetermined leftward movement of valve spool 18, the shoulder 42 of pin 36 will abut the shoulder 34 of stepped diameter 32. A plurality of slots 70 in shoulder 42 permit the passage of fluid from passage 35 to passage 26. This position of pin 36 is shown in FIG. 2. After this condition occurs, the pin 36 will no longer move longitudinally through the aperture 30 such that further changes in orifice 30 will not occur. The valve spool 18 may continue to move to the left slightly or may be restricted from further movement by the solid height of spring 22. This will generally be occasioned by a slight rise in output flow as seen in curve 62.

The valve spool 18 includes internally a pressure regulator valve which will limit the maximum system pressure and may be constructed in accordance with the valve shown in U.S. Pat. No. 2,996,013 issued to Thompson et al on Aug. 15, 1961. As is well-known, these types of relief valves provide maximum system pressure regulation through the flow control valve mechanism.

The encapsulated or unitary structure described above for variable restriction 20 can be assembled or disassembled from a power steering pump as a unit. This permits the output flow rate of the power steering pump to be changed easily and, in mass production, a number of output flow curves can be utilized without substantial change in production methods, since the control restriction can be assembled and stored at the production facility. The pin 36 of the variable restriction 20 can have various cross-sectional areas depending on the shape of curve 62 which is desired. For example, if it is desired to have lesser or greater slope between points 64 and 66, the length of tapered portion 46 can be adjusted accordingly to provide the desired slope. If a different minimum flow rate is desired, it can be achieved through a change in the diameter of cylindrical portion 48.

Those skilled in the art will be very much aware of the variety of flow curves which can be achieved with the present invention. However, the primary and foremost benefit of the subject invention is the fact that an encapsulated flow droop type restriction is 100% self-contained within the plug 24. This variable orifice can be preassembled and tested as a unit prior to being installed in a conventional power steering pump and will readily permit changing the flow rate characteristics of the pump by merely interchanging the encapsulated variable restriction members.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A flow control structure for a hydraulic pump having a valve member responsive to the pressure differential across the flow control structure to direct a portion of the hydraulic fluid displaced by the pump to the reservoir, said flow control structure comprising; a housing; a flow passage through said housing have an inlet orifice; a longitudinally movable member having a variable cross-sectional area in the longitudinal direction and being disposed in said housing and extending through said inlet orifice into abutting relation with said valve member; spring means for urging said movable member into abutment with said valve member and for moving said movable member longitudinally when said valve member moves to effectively change the flow area of said inlet orifice and the resulting pressure differential across said flow control structure; and a stop means on said movable member and said housing for limiting the movement of said movable member to a predetermined amount and maintaining the flow area of the inlet orifice at a constant value.

2. A flow control structure for a hydraulic pump having a valve member responsive to the pressure differential across the flow control structure to direct a portion of the hydraulic fluid displaced by the pump to the reservoir, said flow control structure comprising; a housing; a flow passage through said housing having an inlet orifice; a longitudinally movable member having a small diameter cylindrical section, a large diameter cylindrical section and a tapering section intermediate said cylindrical sections and the movable member being disposed in said housing and extending through said inlet orifice with the end of the small diameter cylindrical section in abutting relation with said valve member; spring means for urging said movable member through said inlet orifice into abutment with said valve member and for moving said movable member longitudinally when said valve member moves to effectively change the flow area of said inlet orifice and the resulting pressure differential across said flow control structure when said tapered section is located in said inlet orifice; and a stop means on said movable member and said housing for limiting the longitudinal movement of said movable member to a predetermined amount and maintaining the flow area of the inlet orifice at a constant value as determined by said large diameter cylindrical section.

3. A flow control valve structure for a hydraulic pump having a valve member responsive to the pressure differential across the flow control structure to direct a portion of the hydraulic fluid displaced by the pump to the reservoir, said flow control structure comprising; a housing; a flow passage through said housing having an aperture; a longitudinally movable member having a variable cross-sectional area in the longitudinal direction and being disposed in said housing and extending through said aperture into abutting relation with said valve member, and cooperating with said aperture to form a flow restriction; spring means for urging said movable member through said aperture into abutment with said valve member for moving said movable member longitudinally when said valve member moves to effectively change the flow area of the flow restriction; and a stop means on said movable member and said housing for limiting the movement of said movable member to a predetermined amount and maintaining the flow area of the flow restriction at a constant value.

* * * * *